US005899334A

United States Patent [19]

Domerchie et al.

[11] Patent Number: 5,899,334

[45] Date of Patent: May 4, 1999

[54] RECLOSABLE TRANSPARENT WIPER BLADE PACKAGE

[75] Inventors: Anthony Domerchie, Waukegan, Ill.; Kevin Putnam, Pardeeville, Wis.

[73] Assignee: Portage Plastics Corporation, Portage, Wis.

[21] Appl. No.: 08/846,836

[22] Filed: May 1, 1997

Related U.S. Application Data

[60] Provisional application No. 60/016,739, May 2, 1996.

[51] Int. Cl.[6] ..... B65D 75/00

[52] U.S. Cl. ..... 206/470; 206/776; 206/1.5

[58] Field of Search ..... 206/461, 464, 206/465, 467, 470, 775, 776–769, 770, 361, 1.5; 220/4.23, 337

[56] References Cited

U.S. PATENT DOCUMENTS 5,366,104 11/1994 Armstrong ..... 220/4.23 X
5,540,324 7/1996 Knapp ..... 206/461 X

*Primary Examiner*—Jacob K. Ackun
*Attorney, Agent, or Firm*—Joseph G. Navman

[57] ABSTRACT

A transparent carton of long thin shape for wiper blades, including an integral hinge connecting a cover section to a bottom section along its entire length, interfitting flanges on the bottom and cover sections which, when engaged to close the package, provide an interlocked full length closure which can readily be opened and reclosed. The cover section also includes a plurality of small shelves in its interior, adjacent its main panel, to retain a display card. One of the main panels of one of the carton sections may incorporate suitable measurement scales. One end of the carton also may include a hanger means for hanging the packaged wiper blades on pegs of a display rack.

5 Claims, 2 Drawing Sheets

RECLOSABLE TRANSPARENT WIPER BLADE PACKAGE

RELATED APPLICATION

This application is based upon provisional patent application Ser. No. 60/016,739 filed May 2, 1996.

BACKGROUND OF THE INVENTION

The invention relates to packages for windshield wiper blades and rubber refills for such blades, and particularly to a clamshell-like package member of transparent material.

A number of factors enter into the long and relatively thin packaging for windshield wiper blades. To conserve space, the package configuration generally follows the outline of the product, resulting in a cross-section of minimal height, a width of four to six times the height, and a considerable length. By way of example, the cross-section may be one-half to three-quarters of an inch high or thick, by one and one-half to three inches in width. Lengths may vary from fourteen to more than twenty inches.

Original equipment wiper blades are packaged (often in large multiples) for protection and convenience, e.g. the blades might be arranged in rows and layers in a box, separated by protective packing. However, the after-market for replacement wiper blades requires display and instruction features in individual packages, to attract and assist the less skilled and less informed vehicle owners. As a result, it has become customary to utilize wiper blade packages with transparent protective features, with some means to hang the long narrow packages on display racks, and/or stacked on shelves, with a printed card or the like having printed instructions as well as decoration and/or illustration. This type of package is, generally, a modified form of blister pack. An example is disclosed in U.S. Pat. No. 5,379,896 issued Jan. 10, 1995.

Another factor is the need to package one or more adapters to facilitate connecting the pivot part of the wiper blade's primary lever to different end configurations of wiper arms. If the package cannot contain these adapters, they may have to be incorporated in small bags attached to a card which also functions as the main carrier of the packages, but does not surround and protect the wiper blade. This factor also applies to small optional accessory packages which the manufacturer may want to include.

The influence of these factors has in recent years led to packages which use a transparent plastic flattened tube-like carton as a major element of the package. In many instances such packages are, unfortunately, often damaged or destroyed during original opening and cannot be re-closed if desired.

SUMMARY OF THE INVENTION

The present invention is directed to an improved transparent package carton for replacement wiper blades, as intended for after-market supply. The package carton (often known as a clam-shell package) is easy to load, including a separate advertising and/or instruction card which is simply fitted in place, and is easy to close since it comprises a unitary interlocking bottom and cover sections. The interlocking feature results in a securely closed package which is, never the less, readily opened, is resealable, and can contain any adapters. The transparent carton material may be chosen from recycled clear thin plastics, such as PET, PVC, Styrene or K resins which are available in thin sheet form (e.g. in the order of 0.010 inch thickness), and which can be thermally vacuum formed with minimal waste.

The principal object of the invention is to provide a formed carton for wiper blades of long thin shape, including an integral hinge connecting the cover section to the bottom section along its entire length, to provide interfitting flanges on the bottom and cover, when engaged to close the package, to provide an interlocked full length closure which can readily be opened and re-closed. One end of the carton also may include a hanger means for hanging the packaged wiper blades on pegs of a display rack.

Other objects and advantages of the invention will be apparent from the following description, the accompanying drawings and the appended claims.

DESCRIPTION OF THE PREFERRED EMBODIMENT

Figure 1:
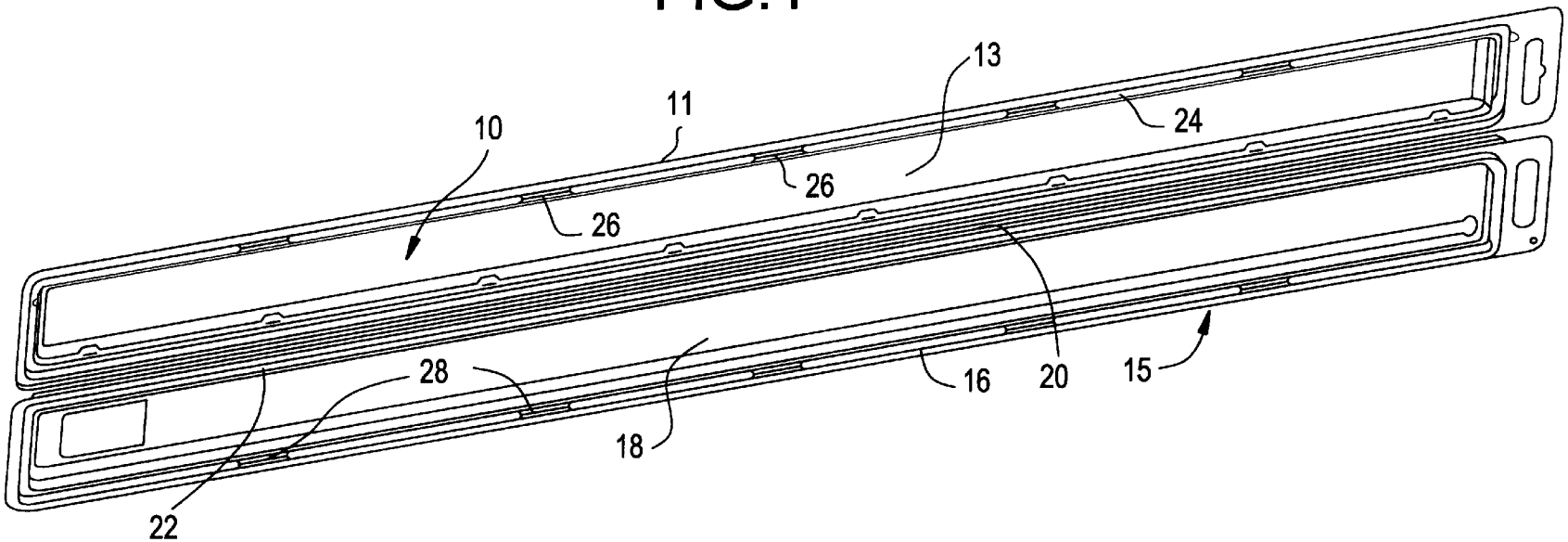
FIG. 1 is a perspective view of the opened unitary package carton itself,(with the identification and instruction card and the wiper blade omitted)
Figure 2:
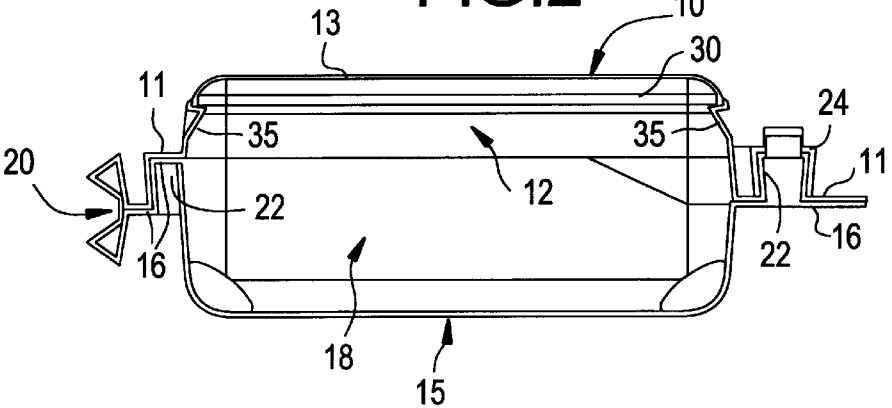
FIG. 2 is an enlarged cross-sectional view through the package carton with the top and bottom thereof in closed position.
Figure 4:
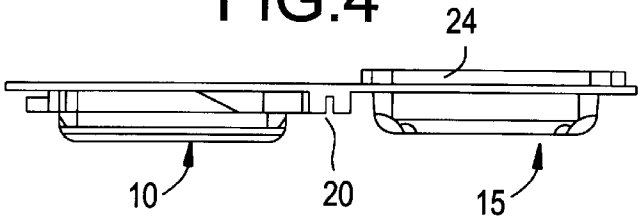
FIG. 4 is an end view of the package carton as shown in FIG. 3.
Figure 3:
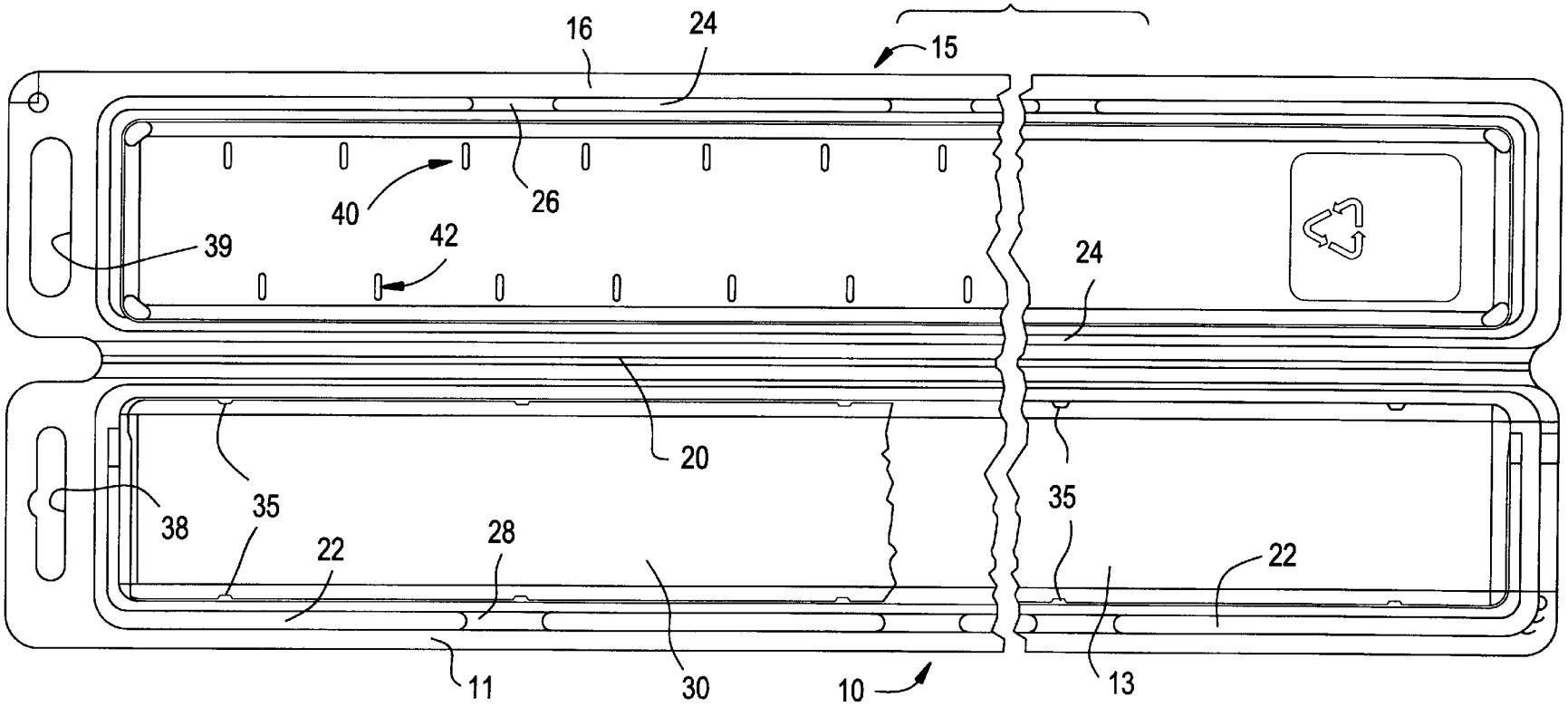
FIG. 3 is an enlarged and broken, longitudinally shortened, plan view of the open package carton with the interior facing upward.

Referring to the drawings, FIGS. 1–4 illustrate a package carton comprising a top section 10 with a lip 11 surrounding the panel 13 of an upper cavity 12, and a complementary bottom section 15 with a corresponding lip 16 surrounding the panel 17 of a lower cavity 18. As can be seen, the carton is substantially longer than it is wide, and its width is considerably greater than its height. One longitudinal edge of each of the lips 11 and 16 is integrally attached by an elongated hinge 20 which extends substantially the full length of the top and bottom sections.

The carton is designed to be thermoformed from a thin sheet of transparent plastic material having the clarity desired so the internal packaged wiper blade, and the printed material on card 30, are clearly visible for inspection. This applies also to any part numbers or other designations which may appear at the end of the card, which end can be folded so as to be visible through the transparent end of the upper cavity when the package is completed. This feature is useful if the cartons are stacked rather than hung for display. The carton material can be quite thin, in the order of 0.010 inch, because the spline and rib formation on the lips 11, 16 add to the rigidity of the carton. Suitable materials, which may be recycled materials, are PET, PVC, Styrene, or K resins. A changeable panel in the mold will provide for embossing of the appropriate package material identification.

Lip 16 has an integral upwardly formed spline member 22 which surrounds the edge of cavity 18, and lip 11 has an integral inwardly formed rib or receiver 24, corresponding in extent and shape (both around the cavities and in cross-section) to spline 22. Thus, when the top section 10 is folded about the hinge 20 and superimposed over bottom section 15, spline 22 enters into rib 24 and forms a locked seal about the periphery of the closed package sections 10, 15. A plurality of integral teeth 26, along rib 24, mate with corresponding cavities 28 formed in spline 22, to lock the top and bottom package sections together. The corners of bottom sections 15 are modified (squared) to resist collapse of the lower cavity 18.

Replacement wiper blades have been conventionally fastened to, or packaged with, a card 30 which bears the manufacturer's trademark, display graphics, and instructions for mounting the blade. In the present package, such a card is of the same general shape as upper cavity panel 13 and thus by providing one or more small shelves or ledges 35 within the upper cavity 12, near panel 13, the edges of card 30 can be trapped so as to place the outward facing surface of the card against panel 13.

The lips 11, 16 include extensions at one end with mating elongated apertures 38, 39 which cooperate when the carton is closed to provide a hanger that can engage with pegs or the like on a display board or case. Also, the carton may incorporate one or more measuring scales thereon for use by the purchaser. Such scales are shown at 40 and 42 in FIG. 3, molded into the panel of the bottom section, in both English and metric measurements. A bubble formation 44 may be included in the corner of lip 16 (see FIG. 3) to hold the corner of the lips 11, 16 slightly separated for ease of opening.

In addition, the formed open cartons will most usually be supplied in stacked form. Due to the nature of the design, the somewhat deep walled depressions presented by the cavities with the carton unit in an open condition will tend to cause the cartons to stick in the nested state. To accommodate automatic packaging apparatus, and to alleviate this nesting situation, a series of small roughly half-circle formations 46 are formed in the corner of the upper section 10 at the turn of the spline 22, to separate slightly the nested empty cartons, and allow them easily to be freed and separated.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A carton for packaging a windshield wiper blade, comprising an elongated integral carton member of thin-walled plastic material having a top section with an upper cavity and a complementary bottom section with a lower cavity, said carton member having a substantially greater length than width, each of said sections having a lip extending about the perimeter of said sections, an integral hinge connecting one length of said lips allowing said sections to be superimposed to define an enclosure from the joined cavities, mating splines and ribs adjacent said lips and arranged to interlock and retain said sections in closed superimposed position, said bottom section having a spline formed thereon adjacent its lip and projecting upward around said lower cavity, said cover section having a rib formed therein extending around said upper cavity to receive said spline, and said spline and said rib having interfitting teeth and cavities providing a lock for said rib and spline.

2. A carton as defined in claim 1 including a plurality of ledges in said top section to engage and support a card within said top section.

3. A carton for packaging a windshield wiper blade, comprising said bottom section has a spline formed thereon adjacent its lip and an elongated integral carton member of thin-walled plastic material having a top section with an upper cavity and a complementary bottom section with a lower cavity, said carton member having a substantially greater length than width, each of said sections having opposed complementary faces extending about the perimeter of said sections, an integral hinge connecting said sections along their length allowing said sections to be superimposed to define an enclosure from the joined cavities, and mating splines and ribs on said opposed faces arranged to interlock and retain said sections in closed superimposed position, said spline and said rib having interfitting teeth and cavities providing a lock for said rib and spline.

4. A carton as defined in claim 3, including a plurality of ledges in said top section to engage and support a card within said top section.

5. A carton as defined in claim 4, wherein a measuring scale is applied lengthwise to said bottom section.

* * * * *

US005899334C1

(12) EX PARTE REEXAMINATION CERTIFICATE (5039th)

United States Patent
Domerchie et al.

(10) Number: US 5,899,334 C1
(45) Certificate Issued: Dec. 14, 2004

(54) RECLOSEABLE TRANSPARENT WIPER BLADE PACKAGE

(75) Inventors: Anthony Domerchie, Waukegan, IL (US); Kevin Putnam, Pardeeville, WI (US)

(73) Assignee: Portage Plastics Corporation, Portage, WI (US)

Reexamination Request:
No. 90/006,404, Oct. 7, 2002

Reexamination Certificate for:

| | |
|---|---|
| Patent No.: | **5,899,334** |
| Issued: | **May 4, 1999** |
| Appl. No.: | **08/846,836** |
| Filed: | **May 1, 1997** |

Related U.S. Application Data

(60) Provisional application No. 60/016,739, filed on May 2, 1996.

(51) Int. Cl.[7] ..... B65D 75/00

(52) U.S. Cl. ..... 206/470; 776/1.5

(58) Field of Search ..... 206/461, 464, 206/465, 467, 470, 775, 776–769, 770, 361, 1.5; 220/4.23, 836, 837

(56) References Cited

U.S. PATENT DOCUMENTS

| | | | |
|---|---|---|---|
| 2,892,538 | A | 6/1959 | Middleton, Jr. et al. |
| 3,164,478 | A | 1/1965 | Bostrom |
| 3,217,867 | A | 11/1965 | Harris |
| 3,379,774 | A | 4/1968 | Forni et al. |
| 3,933,296 | A | 1/1976 | Ruskin et al. |
| 3,948,455 | A | 4/1976 | Schwartz |
| 4,005,776 | A | 2/1977 | Seeley |
| 4,016,972 | A | 4/1977 | Szamborski |
| 4,030,850 | A | 6/1977 | Hyde |
| 4,058,212 | A | 11/1977 | Wyslotsky |
| 4,106,621 | A | 8/1978 | Sorenson |
| 4,183,432 | A | 1/1980 | Lemaire |
| 4,193,496 | A | 3/1980 | Barratt |
| 4,202,464 | A | 5/1980 | Mohs et al. |
| 4,225,077 | A | 9/1980 | Veitinger |
| 4,236,636 | A | 12/1980 | Kuchenbecker |
| 4,344,533 | A | 8/1982 | Olsen |
| 4,475,881 | A | 10/1984 | Borst et al. |
| 4,494,650 | A | 1/1985 | Cullen |
| 4,512,474 | A | 4/1985 | Harding |
| 4,570,818 | A | 2/1986 | Borst et al. |
| 4,576,330 | A | 3/1986 | Schepp |
| D283,488 | S | 4/1986 | Stevens |
| D283,489 | S | 4/1986 | Stevens |
| 4,602,719 | A | 7/1986 | Borst |
| D288,481 | S | 2/1987 | Holewinski et al. |
| D288,606 | S | 3/1987 | Blatherwick et al. |
| 4,739,883 | A | 4/1988 | Mohs et al. |
| 4,739,900 | A | 4/1988 | Borst |
| D295,573 | S | 5/1988 | Williams |
| 4,917,261 | A | 4/1990 | Borst |
| 4,930,627 | A | 6/1990 | Borst et al. |
| 4,948,267 | A | 8/1990 | Kaldenbaugh |
| 4,986,438 | A | 1/1991 | Borst |
| 5,012,927 | A | 5/1991 | Borst |
| 5,012,928 | A | 5/1991 | Proffitt et al. |
| 5,027,947 | A | 7/1991 | Reighart |
| 5,038,936 | A | 8/1991 | Borst |
| 5,040,680 | A | 8/1991 | Wilson et al. |
| 5,046,659 | A | 9/1991 | Warburton |
| 5,060,814 | A | 10/1991 | Oglesbee |
| 5,077,064 | A | 12/1991 | Hustad et al. |
| D327,220 | S | 6/1992 | Proffitt et al. |

(List continued on next page.)

*Primary Examiner*—David T. Fidei

(57) ABSTRACT

A transparent carton of long thin shape for wiper blades, including an integral hinge connecting a cover section to a bottom section along its entire length, interfitting flanges on the bottom and cover sections which, when engaged to close the package, provide an interlocked full length closure which can readily be opened and reclosed. The cover section also includes a plurality of small shelves in its interior, adjacent its main panel, to retain a display card. One of the main panels of one of the carton sections may incorporate suitable measurement scales. One end of the carton also may include a hanger means for hanging the packaged wiper blades on pegs of a display rack.

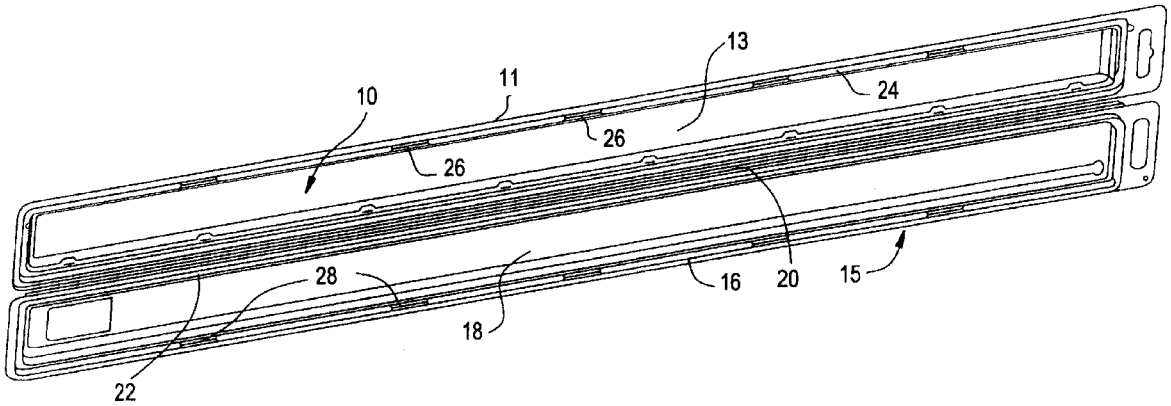

U.S. PATENT DOCUMENTS

| | | | |
|---|---|---|---|
| 5,147,035 | A | 9/1992 | Hartman |
| D329,978 | S | 10/1992 | Ryan |
| 5,156,267 | A | 10/1992 | Yates, Jr. et al. |
| 5,161,687 | A | 11/1992 | Kornell et al. |
| D332,746 | S | 1/1993 | Garcia |
| 5,183,159 | A | 2/1993 | Hojnacki et al. |
| 5,209,354 | A | 5/1993 | Thornhill et al. |
| D336,040 | S | 6/1993 | Pahilippe |
| 5,293,993 | A | 3/1994 | Yates, Jr. et al. |
| 5,366,104 | A | 11/1994 | Armstrong |
| 5,379,896 | A | 1/1995 | Snow et al. |
| D357,626 | S | 4/1995 | Snow et al. |
| 5,405,629 | A | 4/1995 | Marnocha et al. |
| 5,411,140 | A | 5/1995 | Byer |
| D363,022 | S | 10/1995 | Krupa et al. |
| D365,755 | S | 1/1996 | Kanfer et al. |
| 5,540,324 | A | 7/1996 | Knapp |
| 5,573,132 | A | 11/1996 | Kanfer et al. |
| 5,579,288 | A | 11/1996 | Malloy et al. |
| 5,582,853 | A | 12/1996 | Marnocha et al. |
| 5,595,300 | A | 1/1997 | Paik et al. |
| 5,624,057 | A | 4/1997 | Lifshey |
| 5,664,303 | A | 9/1997 | Johnson |
| 5,775,516 | A | 7/1998 | McCumber et al. |
| 5,802,655 | A | 9/1998 | Denton |
| 5,819,939 | A | 10/1998 | Boyer |

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–4 is confirmed.

Claim 5 is cancelled.

New claims 6–9, 10 and 11 are added and determined to be patentable.

*6. A carton as defined in claim 4 further comprising a lengthwise-extending measuring scale integrally formed in said bottom section.*

*7. A carton for packaging a windshield wiper blade, comprising:*

*an elongated integral carton member of thin-walled plastic material, formed of one piece unitary construction, having a top section with an upper cavity and a complementary bottom section with a lower cavity,*

*said carton member having a substantially greater length than width such that its length is a plurality of times its width,*

*each of said sections having a lip extending about the perimeter of said sections,*

*an integral hinge connecting one length of said lips in a lengthwise direction relative to said carton member allowing said sections to be superimposed to define an enclosure from the joined cavities,*

*mating splines and ribs adjacent said lips and arranged to interlock and retain said sections in closed superimposed position,*

*said bottom section having a spline formed thereon adjacent its lip and projecting upward around said lower cavity,*

*said cover section having a rib formed therein extending around said upper cavity to receive said spline, and*

*said spline and said rib having interfitting teeth and cavities providing a lock for said rib and spline.*

*8. A carton as defined in claim 7 wherein each one of said lips comprises a generally planar flange.*

*9. A carton as defined in claim 7 wherein each one of said upper and lower cavities have substantially the same length and said integral hinge extends substantially the same length as said length of said upper and lower cavities.*

*10. A carton for packaging a windshield wiper blade, comprising:*

*an elongated integral carton member of thin-walled plastic material having a top section with an upper cavity and a complementary bottom section with a lower cavity,*

*said carton member having a substantially greater length than width such that its length is a plurality of times its width,*

*said carton member having a clamshell configuration and being of reclosable construction,*

*each of said sections having a lip extending about the perimeter of said sections,*

*an integral hinge connecting one length of said lips in a longitudinal direction relative to each one of said cavities allowing said sections to be superimposed to define an enclosure from the joined cavities with said enclosure configured so as to accept a windshield wiper blade or a windhsield wiper blade refill in said enclosure,*

*mating splines and ribs adjacent said lips and arranged to interlock and releasably retain said sections in closed superimposed position,*

*said bottom section having a spline formed thereon adjacent its lip and projecting upward around said lower cavity,*

*said cover section having a rib formed therein extending around said upper cavity to receive said spline, and*

*said spline and said rib having interfitting teeth and cavities providing a releasable lock for said rib and spline.*

*11. A carton for packaging a windshield wiper blade, comprising:*

*an elongated integral carton member of thin-walled plastic material of one piece and unitary construction, a top section with an integrally formed upper cavity and a complementary bottom section with an integrally formed lower cavity,*

*said carton member having a substantially greater length than width such that its length is a plurality of times its width,*

*each of said sections having a lip extending about the perimeter of said sections with each said lip comprising a planar flange,*

*an integral hinge connecting one length of said lips in a lengthwise direction relative to said carton member allowing said sections to be superimposed to define an enclosure from the joined cavities when disposed in a closed superimposed position,*

*mating splines and ribs adjacent said lips and arranged to releasably interlock and releasably retain said sections in closed superimposed position and which help structurally rigidify said carton member,*

*said bottom section having a spline formed thereon adjacent its lip and projecting upward around said lower cavity,*

*said cover section having a rib formed therein extending around said upper cavity to receive said spline,*

*said spline and said rib having interfitting teeth and cavities providing a releasable lock for said rib and spline, and*

*wherein said carton member is of tubular construction when disposed in closed superimposed position and said enclosure of said carton member has a generally rectangular transverse cross section and a generally rectangular lengthwise cross section.*

* * * * *